US009713839B2

(12) United States Patent
Honda et al.

(10) Patent No.: US 9,713,839 B2
(45) Date of Patent: Jul. 25, 2017

(54) CONTINUOUS CASTING METHOD

(71) Applicant: NISSHIN STEEL CO., LTD., Tokyo (JP)

(72) Inventors: Yuuki Honda, Yamaguchi (JP); Hiroshi Morikawa, Yamaguchi (JP); Hiroaki Cho, Yamaguchi (JP); Noriaki Nukushina, Yamaguchi (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 15/025,206

(22) PCT Filed: Sep. 24, 2014

(86) PCT No.: PCT/JP2014/075268

§ 371 (c)(1),
(2) Date: Mar. 25, 2016

(87) PCT Pub. No.: WO2015/046238

PCT Pub. Date: Apr. 2, 2015

(65) Prior Publication Data

US 2016/0228945 A1 Aug. 11, 2016

(30) Foreign Application Priority Data

Sep. 27, 2013 (JP) ..... 2013-200834
Sep. 22, 2014 (JP) ..... 2014-192187

(51) Int. Cl.
*B22D 11/106* (2006.01)
*B22D 11/111* (2006.01)
(Continued)

(52) U.S. Cl.
CPC ..... *B22D 11/002* (2013.01); *B22D 11/00* (2013.01); *B22D 11/041* (2013.01); *B22D 11/10* (2013.01);
(Continued)

(58) Field of Classification Search
CPC ... B22D 11/002; B22D 11/106; B22D 11/108; B22D 11/11; B22D 11/111; B22D 11/117; B22D 41/54
(Continued)

(56) References Cited

U.S. PATENT DOCUMENTS 5,902,511 A * 5/1999 Perich ..... B22D 41/54 222/606
7,591,976 B2 * 9/2009 Ogata ..... B22D 41/54 164/437
(Continued)

FOREIGN PATENT DOCUMENTS

CN 201644737 U * 11/2010
CN 102816979 A 12/2012
(Continued)

OTHER PUBLICATIONS

EPO machine translation of JP 2000-273585, Oct. 3, 2000.*
(Continued)

*Primary Examiner* — Kevin E Yoon
(74) *Attorney, Agent, or Firm* — Rothwell, Figg, Ernst & Manbeck, p.c.

(57) ABSTRACT

In a continuous casting method for casting aluminum-deoxidized molten stainless steel 1 by using a continuous casting apparatus 100 in which a long nozzle 3 extending into a tundish 101 is provided at a ladle 2, the molten stainless steel 1 is poured into the tundish 101 through the long nozzle 3, while the spout 3*a* of the long nozzle 3 is being immersed in the molten stainless steel 1 that has been poured, and the molten stainless steel 1 in the tundish 101 is poured into a casting mold 105. A TD powder 5 is sprayed so that the powder covers the surface of the molten stainless steel 1 in the tundish 101, and nitrogen gas is supplied around the molten stainless steel 1. A calcium-containing
(Continued)

material is added to the molten stainless steel 1 in a state other than a state of retention in the tundish 101.

9 Claims, 6 Drawing Sheets

(51) Int. Cl.
*B22D 11/00* (2006.01)
*B22D 11/10* (2006.01)
*B22D 11/108* (2006.01)
*B22D 11/11* (2006.01)
*B22D 11/041* (2006.01)

(52) U.S. Cl.
CPC ..... *B22D 11/106* (2013.01); *B22D 11/108* (2013.01); *B22D 11/11* (2013.01); *B22D 11/111* (2013.01)

(58) Field of Classification Search
USPC ..... 164/459–491
See application file for complete search history.

(56) References Cited

U.S. PATENT DOCUMENTS

| | | | | |
|---|---|---|---|---|
| 7,682,418 | B2 * | 3/2010 | Sarbendu | C21C 7/0056 75/526 |
| 8,042,602 | B2 * | 10/2011 | Wechsler | B22D 11/16 164/418 |
| 2010/0136363 | A1 * | 6/2010 | Valdez | B22D 11/111 428/586 |
| 2012/0024112 | A1 * | 2/2012 | Dressel | B22D 11/108 75/526 |

FOREIGN PATENT DOCUMENTS

| | | | | |
|---|---|---|---|---|
| EP | 3040137 | A1 | | 7/2016 |
| EP | 3040138 | A1 | | 7/2016 |
| JP | S57184563 | A | | 11/1982 |
| JP | 1-122644 | A | | 5/1989 |
| JP | 3-183721 | A | | 8/1991 |
| JP | H06599 | A | | 1/1994 |
| JP | 6-39505 | A | | 2/1994 |
| JP | H0857599 | A | | 3/1996 |
| JP | 2000273585 | A | * | 10/2000 |
| JP | 2010201504 | A | | 9/2010 |
| JP | 2012061516 | A | * | 3/2012 |

OTHER PUBLICATIONS

EPO machine translation of JP 2012-061516, Mar. 29, 2012.*
EPO machine translation of CN 201644737, Nov. 24, 2010.*
International Search Report issued in PCT Appln. No. PCT/JP2014/075268 on Dec. 22, 2014, 1 page.
Kaike et al., "Pure Steel Production Technology and Present Situation", Henan Metallurgy, Jun. 2003, vol. 11, No. 3, 11 pages including an English language translation of the relevance of the reference.
Office Action cited in the corresponding Chinese Application No. 201480053581.3 dated Feb. 7, 2017, 6 pages.
European Search Report issued in European Application 14848812.5 dated Mar. 3, 2017, 8 pages.

* cited by examiner

CONTINUOUS CASTING METHOD

CROSS REFERENCE TO RELATED APPLICATIONS

This application is a 35 U.S.C. §371 National Phase Entry Application from PCT/JP2014/075268, filed Sep. 24, 2014, and designating the United States, which claims priority to Japanese Patent Application No. 2013-200834, filed Sep. 27, 2013 and Japanese Patent Application No. 2014-192187, filed Sep. 22, 2014. The above identified applications are incorporated herein by reference in their entirety.

TECHNICAL FIELD

This invention relates to a continuous casting method.

BACKGROUND ART

In the process for manufacturing stainless steel, which is a kind of metal, molten iron is produced by melting raw materials in an electric furnace, molten steel is obtained by subjecting the produced molten iron to refining including decarburization for instance performed to remove carbon, which degrades properties of the stainless steel, in a converter and a vacuum degassing apparatus, and the molten steel is thereafter continuously cast to solidify to form a plate-shaped slab for instance. In the refining process, the final composition of the molten steel is adjusted.

In the continuous casting process, molten steel is poured from a ladle into a tundish and then poured from the tundish into a casting mold for continuous casting to cast. In this process, a seal gas shielding the molten steel surface from the atmosphere is supplied around the molten steel transferred from the ladle in the tundish to the casting mold in order to prevent the molten steel with the finally adjusted composition from reacting with nitrogen or oxygen contained in the atmosphere, such a reaction increasing the content of nitrogen or causing oxidation.

For example, PTL 1 discloses a method for manufacturing a continuous-cast (continuously cast) slab by using an argon gas as the seal gas.

CITATION LIST

Patent Literature

[PTL 1]
Japanese Patent Application Publication No. H4-284945.

SUMMARY OF INVENTION

Technical Problem

Where the argon gas is used as the seal gas, as in the manufacturing method of PTL 1, the argon gas taken into the molten steel remains therein in the form of bubbles, and bubble defects caused by the argon gas, that is, surface defects, appear on the surface of the continuously cast slab and in the vicinity thereof. Yet another problem is that where such surface defects appear on the continuously cast slab, the surface needs to be ground to ensure the required quality, increasing the cost. Accordingly, the inventors have developed a technique for using nitrogen, which is an inactive gas and hardly remains in the form of bubbles in a molten steel, as a seal gas, and then forming a powder layer on the surface of molten steel to prevent the nitrogen from dissolving in the molten steel.

Further, some stainless steel grades include easily oxidizable titanium as a component. When stainless steel of such grades is refined, aluminum deoxidation aimed at removal of oxygen contained in the molten steel is performed by adding aluminum, which reacts with oxygen even more easily, thereby preventing the reaction of titanium with oxygen blown into the steel for decarburization. Aluminum reacts with oxygen and forms alumina, thereby removing the oxygen contained in the molten steel. However, since alumina has a high melting point of 2020° C., alumina contained in the molten steel precipitates in the casting process in which the temperature of the molten steel decreases, and the precipitated alumina can adhere to and deposit on the inner wall of the nozzle extending from the tundish to the casting mold, thereby clogging the nozzle. The inventors had taken countermeasures to prevent the nozzle from clogging by adding a Ca-containing material to the molten steel in the tundish to convert alumina into calcium aluminate having a lower melting point.

However, the problem arising when a Ca-containing material is added to the tundish is that nitrogen serving as a seal gas is admixed with the molten steel, the admixed nitrogen comes into contact and reacts with components contained in the molten steel, and the reaction products precipitate as inclusions close to the slab surface thereby creating surface defects.

The present invention has been created to resolve the above-described problems, and it is an objective of the invention to provide a continuous casting method in which surface defects in a slab (solid metal) obtained by casting a molten steel are reduced, while preventing a nozzle extending from a tundish to casting mold from clogging during casting of an aluminum-deoxidized molten steel (molten metal).

Solution to Problem

In order to resolve the above-described problems, the present invention provides a continuous casting method for casting a solid metal by pouring a molten metal, subjected to aluminum deoxidation in a ladle, into a tundish and continuously pouring the molten metal in the tundish into a casting mold, the continuous casting method including: a long nozzle installation step for providing in the ladle a long nozzle extending into the tundish as a pouring nozzle for pouring the molten metal in the ladle into the tundish; a casting step for pouring the molten metal into the tundish through the long nozzle, while a spout of the long nozzle is being immersed into the molten metal poured into the tundish, and pouring the molten metal in the tundish into the casting mold; a spraying step for spraying a tundish powder so that the powder covers the surface of the molten metal in the tundish; a seal gas supply step for supplying a nitrogen gas as a seal gas around the molten metal sprayed with the tundish powder; and an addition step for adding a calcium-containing material to the molten metal in a state other than a state of retention in the tundish.

Advantageous Effects of the Invention

With the continuous casting method in accordance with the present invention, surface defects in a solid metal obtained by casting a molten steel can be reduced, while preventing clogging of a nozzle extending from a tundish to a casting mold during casting of an aluminum-deoxidized molten metal.

DESCRIPTION OF EMBODIMENTS

Embodiment 1

The continuous casting method according to Embodiment 1 of the invention will be explained hereinbelow in greater detail with reference to the appended drawings. Explained in the below-described embodiment is a method for continuously casting a stainless steel including titanium (Ti) as a component, such a stainless steel requiring deoxidation with aluminum in a secondary refining process.

Stainless steel is manufactured by implementing a melting process, a primary refining process, a secondary refining process, and a casting process in the order of description.

In the melting process, scrap or alloys serving as starting materials for stainless steel production are melted in an electric furnace to produce molten iron, and the produced molten iron is transferred into a converter. In the primary refining process, crude decarburization is performed to remove carbon contained in the melt by blowing oxygen into the molten iron in the converter, thereby producing a molten stainless steel and a slag including oxides and impurities. Further, in the primary refining process, the components of the molten stainless steel are analyzed and crude adjustment of the components is implemented by charging alloys for bringing the steel composition close to the target composition. The molten stainless steel produced in the primary refining process is tapped into a ladle and transferred to the secondary refining process.

Figure 1:
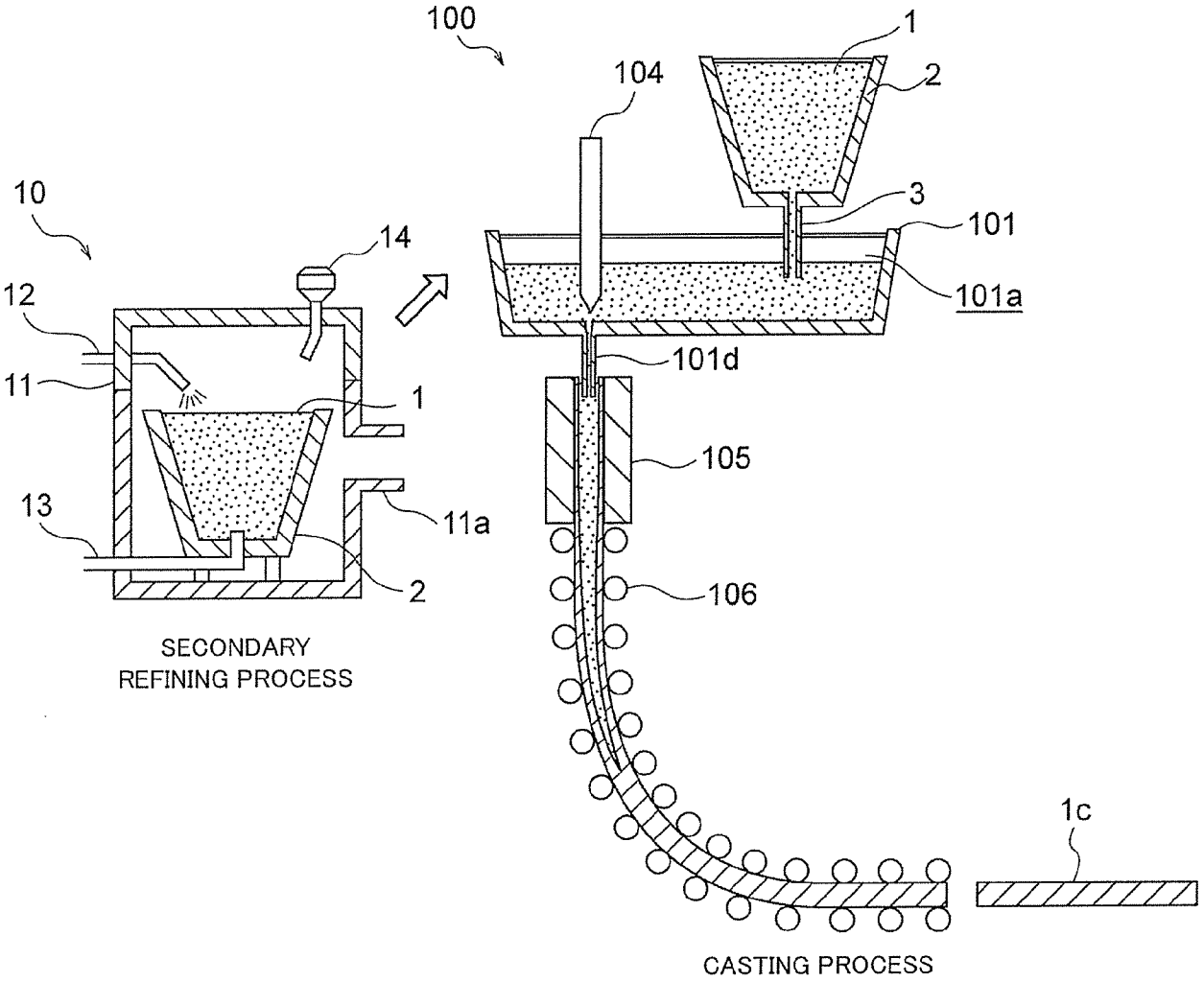
FIG. 1 is a schematic diagram illustrating the secondary refining process and casting process in the stainless steel manufacturing process.

Referring to FIG. 1, in the secondary refining process, the molten stainless steel 1 is introduced, together with the ladle 2, into a vacuum oxygen decarburization apparatus 10 (vacuum degassing apparatus, abbreviated as VOD, referred to hereinbelow as VOD), and finishing decarburization treatment, final desulfurization, removal of gases such as oxygen, nitrogen, and hydrogen, and removal of inclusions are performed. As a result of the above-described treatment on the molten stainless steel 1, a molten stainless steel having the target properties of a product is obtained. Further, in the secondary refining process, the components of the molten stainless steel 1 are analyzed and final adjustment of the components is implemented by charging alloys for bringing the steel composition close to the target composition. Here, the molten stainless steel 1 constitutes a molten metal.

The VOD 10 has a vacuum vessel 11 into which the ladle 2 can be introduced. The molten stainless steel 1 from which slag including impurities such as oxides has been removed in the primary refining process is introduced into the ladle 2. The vacuum vessel 11 has a discharge tube 11*a* for discharging the air contained therein to the outside. The discharge tube 11*a* is configured to be connected to a vacuum pump and a vapor ejector (not depicted in the figure).

Further, the VOD 10 has an oxygen gas lance 12 configured to extend to the inside from the outside of the vacuum vessel 11 and to enable blowing of oxygen from above the lance 2 into the molten stainless steel 1 inside the vacuum vessel 11. Carbon contained in the molten stainless steel 1 is removed by reaction with the blown oxygen and oxidation into carbon monoxide. This reaction of the contained carbon is accelerated by depressurizing the vacuum vessel 11.

The VOD 10 also has in the vacuum vessel 11 an argon gas lance 13 for supplying an argon (Ar) gas for stirring from the bottom of the ladle 2 into the molten stainless steel 1 and an alloy hopper 14 for charging an alloy from above into the molten stainless steel 1 in the ladle 2.

Ti, which easily reacts with oxygen, is added as a component to the molten stainless steel 1 in the vacuum vessel 11. Therefore, an alloy containing aluminum (Al) which is higher than Ti in reactivity with oxygen is added as a deoxidizer (oxygen scavenging agent) from the alloy hopper 14 in order to remove the unreacted oxygen contained in the molten stainless steel 1 before Ti is added. Al in the Al-containing alloy reacts with oxygen and becomes alumina ($Al_2O_3$) which is mostly aggregated by stirring with Ar gas and absorbed into the slag. Nitrogen and hydrogen contained in the molten stainless steel 1 are removed from the molten stainless steel 1 by depressurizing the vacuum vessel 11.

In the casting process, the ladle 2 is taken out from the vacuum vessel 11 and set at a continuous casting apparatus (CC) 100. Molten stainless steel 1 in the ladle 2 is poured into the continuous casting apparatus 100 and cast, for example, into a slab-shaped stainless steel 1*c* as a solid metal with a casting mold 105 provided in the continuous casting apparatus 100. The cast stainless steel billet 1*c* is hot rolled or cold rolled in the subsequent rolling process (not illustrated in the figures) to obtain a hot-rolled steel strip or cold-rolled steel strip.

The configuration of the continuous casting apparatus (CC) 100 will be explained hereinbelow in greater detail.

Figure 2:
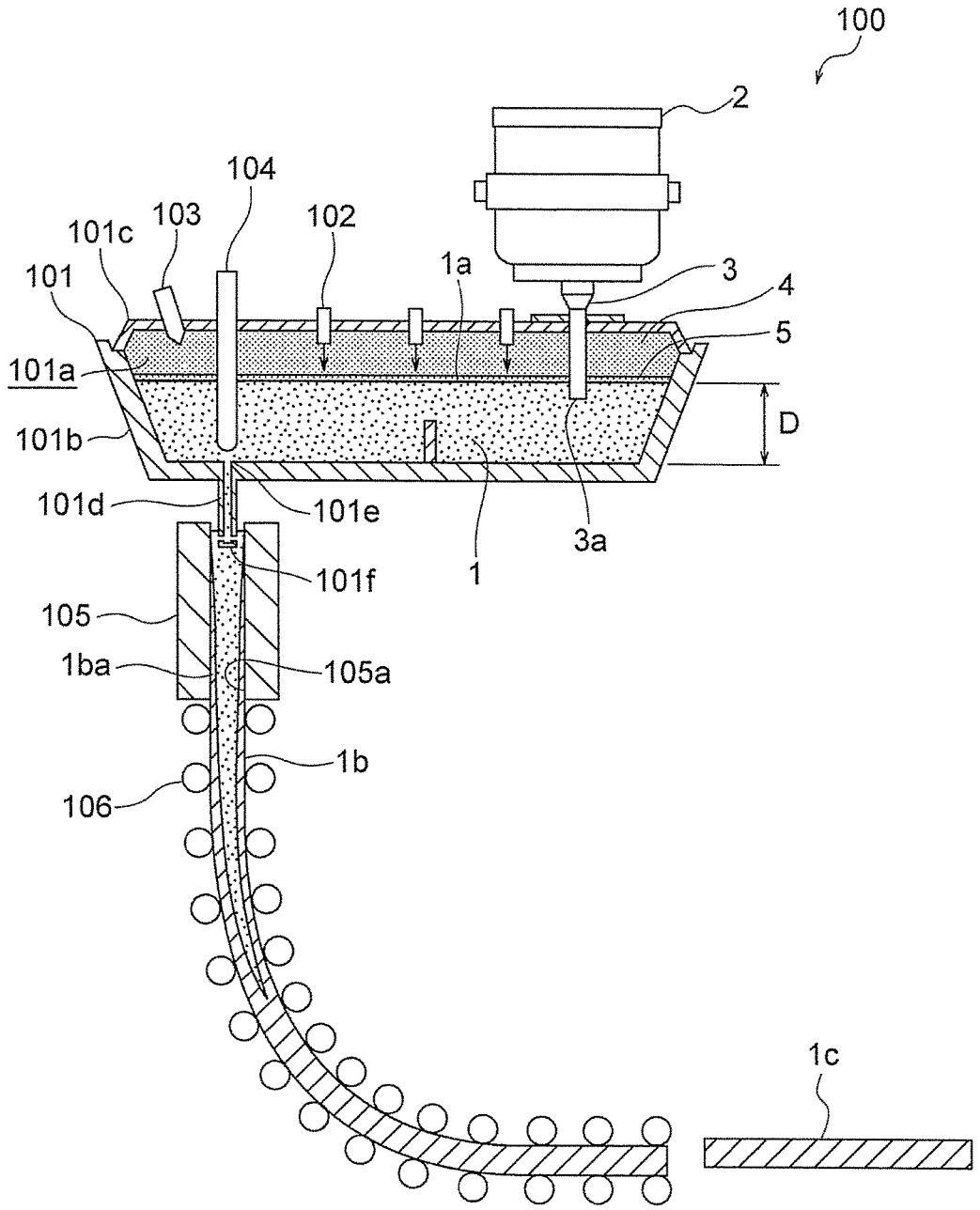
FIG. 2 is a schematic diagram illustrating the configuration of a continuous casting apparatus which is used in the continuous casting method according to Embodiment 1 of the invention.

Further, referring to FIG. 2, the continuous casting apparatus 100 has a tundish 101 which is a container for temporarily retaining the molten stainless steel 1 transferred from the ladle 2 and transferring the molten stainless steel to the casting mold 105. The tundish 101 has a main body 101*b* which is open at the top, an upper lid 101*c* that closes the open top of the main body 101*b* and shields the main body from the outside, and an immersion nozzle 101*d* extending from the bottom of the main body 101*b*. In the tundish 101, a closed inner space 101*a* is formed inside thereof by the main body 101*b* and the upper lid 101*c*. The immersion nozzle 101*d* is opened from the bottom of the main body 101*b* in the inner space 101*a* at the inlet port 101*e*.

Further, the ladle 2 is set above the tundish 101, and a long nozzle 3 which is a pouring nozzle extending through the upper lid 101*c* into the inner space 101*a* is connected to the bottom of the ladle 2. A spout 3*a* at the lower tip of the long nozzle 3 is opened in the inner space 101*a*. Sealing is performed and gas tightness is ensured between the long nozzle 3 and the upper lid 101*c*.

A plurality of gas supply nozzles 102 are provided in the upper lid 101*c*. The gas supply nozzles 102 are connected to a gas supply source (not depicted in the figures) and deliver a predetermined gas from the top downward into the inner space 101*a*. The long nozzle 3 is configured such that the predetermined gas is also supplied into the long nozzle.

A powder nozzle 103 is provided in the upper lid 101*c*, which is for charging a tundish powder (referred to hereinbelow as "TD powder") 5 from the top downward into the inner space 101*a*. The powder nozzle 103 is connected to a TD powder supply source (not depicted in the figure). The TD powder 5 is constituted by a synthetic slag agent, or the like, and where the surface of the molten stainless steel 1 is covered thereby, the following effects are produced on the molten stainless steel 1: the surface of the molten stainless steel 1 is prevented from oxidation, the temperature of the molten stainless steel 1 is maintained, and inclusions contained in the molten stainless steel 1 are dissolved and absorbed.

A rod-shaped stopper 104 movable in the vertical direction is provided above the immersion nozzle 101*d*. The stopper 104 extends from the inner space 101*a* of the tundish 101 to the outside through the upper lid 101*c*.

Where the stopper 104 is configured such that where the stopper is moved downward, the tip thereof can close the inlet port 101*e* of the immersion nozzle 101*d*, and also such that where the stopper is pulled upward from a position in which the inlet port 101*e* is closed, the molten stainless steel 1 inside the tundish 101 is caused to flow into the immersion nozzle 101*d* and the flow rate of the molten stainless steel can be controlled by adjusting the opening area of the inlet port 101*e* according to the amount of pull-up. Further, sealing is performed and gas tightness is ensured between the stopper 104 and the upper lid 101*c*.

The tip 101*f* of the immersion nozzle 101*d* protruding from the bottom portion of the tundish 101 to the outside extends into a through hole 105*a* of the casting mold 105, which is located therebelow, and opens sidewise.

The through hole 105*a* has a rectangular cross section and passes through the casting mold 105 in the vertical direction. The through hole 105*a* is configured such that the inner wall surface thereof is water cooled by a primary cooling mechanism (not depicted in the figure). As a result, the molten stainless steel 1 inside is cooled and solidified and a slab 1*b* of a predetermined cross section is formed.

A plurality of rolls 106 for pulling downward and transferring the slab 1*b* formed by the casting mold 105 are provided apart from each other below the through hole 105*a* of the casting mold 105. A secondary cooling mechanism (not depicted in the figure) for cooling the slab 1*b* by spraying water is provided between the rolls 106.

The operation of the continuous casting apparatus 100 and the peripheral equipment thereof in the continuous casting method according to Embodiment 1 will be explained hereinbelow.

Referring to FIG. 1 together with FIG. 2, the molten stainless steel 1 which has been transferred from the converter into the ladle 2 after the primary refining is disposed, while remaining in the ladle 2, inside the vacuum vessel 11 of the VOD 10.

Inside the vacuum vessel 11, the molten stainless steel 1 in the ladle 2 is stirred by the Ar gas supplied from the argon gas lance 13, and also depressurized under the effect of the vapor ejector and vacuum pump connected to the discharge tube 11*a*. As a result of the depressurization, the molten stainless steel 1 releases nitrogen and hydrogen contained therein and the content thereof is reduced. Furthermore, since oxygen is blown from the oxygen gas lance 12 into the molten stainless steel 1, carbon contained therein reacts with the oxygen and the content thereof in the steel is reduced. In the molten stainless steel 1 including, as a component, Ti which has high reactivity with oxygen, an Al-containing alloy as a deoxidizer which is higher than Ti in reactivity with oxygen is added from the alloy hopper 14, and Ti is added after the molten stainless steel 1 has been deoxidized with the Al-containing alloy. Further, an alloy for composition adjustment which is a constituent of the molten stainless steel 1 is also added. Al in the Al-containing alloy reacts with oxygen in the molten stainless steel 1 and forms alumina ($Al_2O_3$), most of the $Al_2O_3$ is absorbed into the slag, but part thereof remains in the molten stainless steel 1. As mentioned hereinabove, $Al_2O_3$ contained in the molten stainless steel 1 adheres to the inner wall of the immersion nozzle 101*d* extending from the tundish 101 into the casting mold 105. Therefore, at least one of metallic calcium and a ferrosilicalcium (FeSiCa) alloy, which is a ferrosilicon type alloy, is added to the molten stainless steel 1 with the object of converting $Al_2O_3$ into calcium aluminate which has a lower melting point and preventing the immersion nozzle 101*d* from clogging. Further, the molten stainless steel 1 is also desulfurized in order to reduce the content of sulfur.

Here, the FeSiCa alloy and metallic calcium constitute the calcium-containing material.

The molten stainless steel 1 after the above-described removal of impurities and composition adjustment (that is, after the secondary refining) is transferred together with the ladle 2 from the vacuum vessel 11 into the continuous casting apparatus 100.

Figure 3:
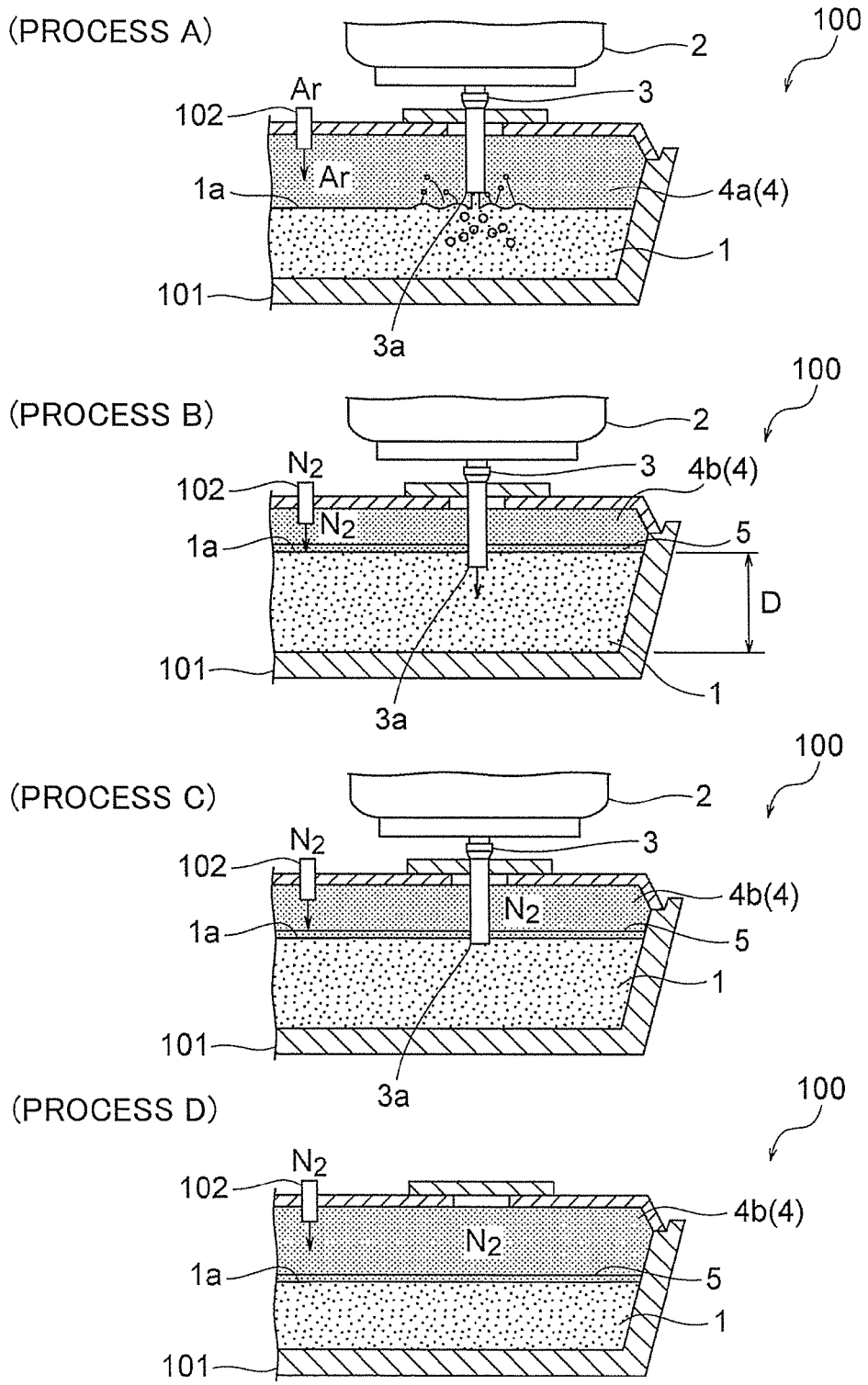
FIG. 3 is a schematic diagram illustrating the state of a tundish depicted in FIG. 2 during the continuous casting.

Referring to FIG. 2 together with FIG. 3, the ladle 2 is disposed above the tundish 101. The long nozzle 3 is then attached to the bottom of the ladle 2, and the distal tip of the long nozzle 3 having the spout 3*a* is extended into the inner space 101*a* of the tundish 101. At this time, the stopper 104 closes the inlet port 101*e* of the immersion nozzle 101*d*.

Then, an Ar gas 4*a* which is an inert gas is injected as a seal gas 4 from the gas supply nozzle 102 into the inner space 101*a* of the tundish 101, and the Ar gas 4*a* is also supplied into the long nozzle 3. As a result, the air which is present in the inner space 101*a* of the tundish 101 and the long nozzle 3 and includes impurities is pushed out of the tundish 101 to the outside, and the inner space 101*a* and the long nozzle 3 are filled with the Ar gas 4*a*. In other words, the region from the ladle 2 to the inner space 101*a* of the tundish 101 is filled with the Ar gas 4*a*.

A valve (not depicted in the figure) which is provided at the ladle 2 is then opened, and the molten stainless steel 1 in the ladle 2 flows down under gravity inside the long nozzle 3 and into the inner space 101*a* of the tundish 101. In other words, the interior of the tundish 101 is in the state illustrated by a process A in FIG. 3.

At this time, the molten stainless steel 1 which has flowed in is sealed on the periphery thereof with the Ar gas 4*a* filling the inner space 101*a* and is not in contact with the air. As a result, nitrogen ($N_2$) which is contained in air and can be dissolved in the molten stainless steel 1 is prevented from dissolving in the molten stainless steel 1 and increasing the concentration of $N_2$ component therein. For this reason, the formation of TiN by contact and reaction of the nitrogen component (N) and the Ti contained as a component in the molten stainless steel 1 is suppressed. TiN forms clusters and is present as large inclusions (for example, with a diameter about 230 μm) in the molten stainless steel 1. However, since the formation of large inclusions by TiN is suppressed, the precipitation of TiN as large inclusions is also suppressed in the molten stainless steel 1 which has been cooled and solidified.

Further, inside the tundish 101, the molten stainless steel 1 which has flowed down from the spout 3*a* of the long nozzle 3 hits the surface 1*a* of the retained molten stainless steel 1. As a result, the Ar gas 4*a* is dragged in and mixed, albeit in a small amount, with the molten stainless steel 1. However, the Ar gas 4*a* does not react with the molten stainless steel 1.

Further, inside the tundish 101, the surface 1*a* of the molten stainless steel 1 is raised by the inflowing molten stainless steel 1. Where the rising surface 1*a* reaches the vicinity of the spout 3*a* of the long nozzle 3, the intensity with which the molten stainless steel 1 flowing down from the spout 3*a* hits the surface 1*a* decreases and the amount of the surrounding gas which is dragged in also decreases. Therefore, the TD powder 5 is sprayed from the powder nozzle 103 towards the surface 1*a* of the molten stainless steel 1. The TD powder 5 is sprayed to cover the entire surface 1*a*.

After the TD powder 5 has been sprayed, a nitrogen ($N_2$) gas 4*b*, which is an inert gas, is injected instead of the Ar gas 4*a* from the gas supply nozzle 102. As a result, inside the inner space 101*a* of the tundish 101, the Ar gas 4*a* is pushed out to the outside, and the region between the TD powder 5 and the upper lid 101*c* of the tundish 101 is filled with the $N_2$ gas 4*b*.

At this time, the TD powder 5 accumulated in a layer configuration on the surface 1*a* of the molten stainless steel 1 blocks contact between the surface 1*a* of the molten stainless steel 1 and the $N_2$ gas 4*b* and prevents the $N_2$ gas 4*b* from dissolving in the molten stainless steel 1. As a result, contact between the nitrogen component (N) and Ti included as a component in the molten stainless steel 1 is suppressed and the formation of TiN is suppressed, hence, the formation of large inclusions by TiN in the molten stainless steel 1 is suppressed, and the precipitation of TiN as large inclusions is also suppressed in the molten stainless steel 1 which has been cooled and solidified.

Further, in the secondary refining process, part of $Al_2O_3$ generated in the deoxidation treatment is not absorbed in slag and remains in the molten stainless steel 1. Since $Al_2O_3$ has a high melting point of 2020° C., it precipitates and forms clusters in the molten stainless steel 1 and is also present in the form of large inclusions in the solidified molten stainless steel 1. Further, $Al_2O_3$ precipitated in the molten stainless steel 1 can adhere and accumulate inside the immersion nozzle 101*d* and in the vicinity thereof, thereby clogging the immersion nozzle 101*d*.

However, at least one of the FeSiCa alloy and metallic calcium is added to the molten stainless steel 1 in the secondary refining process, and those FeSiCa alloy and metallic calcium induce a reaction converting $Al_2O_3$ into calcium aluminate ($12CaO.7Al_2O_3$). The generated $12CaO.7Al_2O_3$ has a melting temperature of 1400° C., which is substantially lower than the melting point of $Al_2O_3$, and dissolves and disperses in the molten stainless steel 1. Therefore, $12CaO.7Al_2O_3$ does not precipitate as large inclusions, such as formed by $Al_2O_3$, in the molten stainless steel 1 and does not clog the immersion nozzle 101*d* by adhering and depositing inside and in the vicinity thereof.

Therefore, as a result of the addition of at least one of the FeSiCa alloy and metallic calcium, even when $Al_2O_3$ remaining in the molten stainless steel 1 has precipitated, it is converted into $12CaO.7Al_2O_3$, dissolved, and dispersed. Further, since at least one of the FeSiCa alloy and metallic calcium is not added to the molten stainless steel 1 located in the tundish 101, the layer of the TD powder 5 covering the molten stainless steel 1 is not disturbed. As a result, the $N_2$ gas 4*b* is prevented from dissolving through the disturbed layer of the TD powder 5 into the molten stainless steel 1 and reacting with Ti contained in the molten stainless steel 1. In other words, the formation of TiN caused by the disturbance of the layer of the TD powder 5 is prevented.

When the content of Si in the molten stainless steel 1 is controlled to a low level, where the FeSiCa alloy is used as the calcium-containing material, the Si content can deviate from the required value. Therefore, it is preferred that metallic calcium be added and/or an immersion nozzle of the tundish 101 which is provided with the below-described dolomite graphite layer be used.

Further, inside the inner space 101*a* of the tundish 101, where the rising surface 1*a* causes the spout 3*a* of the long nozzle 3 to dip into the molten stainless steel 1 and the depth of the molten stainless steel 1 in the inner space 101*a* becomes a predetermined depth D, the stopper 104 rises. As a result, the molten stainless steel 1 in the inner space 101*a* flows into the through hole 105*a* of the casting mold 105 through the interior of the immersion nozzle 101*d*, and casting is started. At the same time, the molten stainless steel 1 inside the ladle 2 is continuously poured through the long nozzle 3 into the inner space 101*a* and new molten stainless steel 1 is supplied into the inner space 101*a*. The interior of the tundish 101 at this time is in a state such as illustrated by process B in FIG. 3.

In the course of casting, the outflow rate of the molten stainless steel 1 from the immersion nozzle 101*d* and the inflow rate of the molten stainless steel 1 through the long nozzle 3 are adjusted such that the molten stainless steel 1 maintains the depth which is close to the predetermined depth D and the surface 1*a* of the molten stainless steel 1 is at a substantially constant position, while maintaining the spout 3*a* of the long nozzle 3 in a state of immersion in the molten stainless steel 1 in the tundish 101.

When the molten stainless steel 1 in the inner space 101*a* has the predetermined depth D, it is preferred that the long nozzle 3 penetrate into the molten stainless steel 1 such that the spout 3*a* be at a depth of about 100 mm to 150 mm from the surface 1*a* of the molten stainless steel 1. Where the long nozzle 3 penetrates to a depth larger than that indicated hereinabove, it is difficult for the molten stainless steel 1 to flow out from the spout 3*a* due to the resistance produced by the internal pressure of the molten stainless steel 1 remaining in the inner space 101*a*. Meanwhile, where the long nozzle 3 penetrates to a depth less than that indicated hereinabove, the surface 1*a* of the molten stainless steel 1, which is controlled such as to be maintained in the vicinity of a predetermined position during casting, can change and the spout 3*a* can be exposed. In such cases, the molten stainless steel 1 which has been poured out hits the surface 1*a* and the $N_2$ gas 4*b* can be dragged in and mixed with the steel.

The molten stainless steel 1 which has flowed into the through hole 105*a* of the casting mold 105 is cooled by the primary cooling mechanism (not depicted in the figure) in the process of flowing through the through hole 105*a*, the steel on the inner wall surface side of the through hole 105*a* is solidified, and a solidified shell 1*ba* is formed. A mold powder is supplied from a tip 101*f* side of the immersion nozzle 101*d* to the inner wall surface of the through hole 105*a*. The mold powder acts to induce slag melting on the surface of the molten stainless steel 1, prevent the oxidation of the surface of the molten stainless steel 1 inside the through hole 105*a*, ensure lubrication between the casting mold 105 and the solidified shell 1*ba*, and maintain the temperature of the surface of the molten stainless steel 1 inside the through hole 105*a*.

The slab 1*b* is formed by the solidified shell 1*ba* and the non-solidified molten stainless steel 1 inside thereof, and the slab 1*b* is grasped from both sides by rolls 106 and pulled further downward and out. In the process of being transferred between the rolls 106, the slab 1*b* which has been pulled out is cooled by water spraying with the secondary cooling mechanism (not depicted in the figure), and the molten stainless steel 1 inside thereof is completely solidified. As a result, by forming a new slab 1*b* inside the casting mold 105, while pulling out the slab 1*b* from the casting mold 105 with the rolls 106, it is possible to form the slab 1*b* which is continuous over the entire extension direction of the rolls 106 from the casting mold 105. The slab 1*b* which is fed out by the rolls 106 is cut to form a slab-shaped stainless steel 1*c*.

The stopper 104 is controlled to adjust the opening area of the inlet port 101*e* of the immersion nozzle 101*d* to maintain the surface of the molten stainless steel 1 inside the through hole 105*a* of the casting mold 105 at a constant height. As a result, the outflow rate of the molten stainless steel 1 is controlled. Furthermore, the inflow rate of the molten stainless steel 1 from the ladle 2 through the long nozzle 3 is adjusted such as to be equal to the outflow rate of the molten stainless steel 1 from the inlet port 101*e*. As a result, the surface 1*a* of the molten stainless steel 1 in the inner space 101*a* of the tundish 101 is controlled such as to maintain a substantially constant position in the vertical direction in a state in which the depth of the molten stainless steel 1 remains close to the predetermined depth D. At this time, the spout 3*a* at the distal end of the long nozzle 3 is immersed into the molten stainless steel 1. Further, the casting state in which the vertical position of the surface 1*a* of the molten stainless steel 1 is maintained substantially constant, while the spout 3*a* is being immersed into the molten stainless steel 1 in the tundish 101, as mentioned hereinabove, is called a stationary state.

Thus, while the casting is performed in the stationary state, the molten stainless steel 1 flowing in from the long nozzle 3 does not hit the surface 1*a* or the TD powder 5. Therefore, a state is maintained in which the $N_2$ gas 4*b* is shielded from the molten stainless steel 1 by the TD powder 5. As a result, the dissolution of the $N_2$ gas 4*b* in the molten stainless steel 1 is prevented.

When no molten stainless steel 1 remains inside the ladle 2, the long nozzle 3 is detached from the ladle 2 and the ladle is replaced with another ladle 2 containing the molten stainless steel 1, while the long nozzle 3 is left in the tundish 101. The long nozzle 3 is connected again to the replacement ladle 2. The casting operation is also continuously performed during the replacement of the ladle 2. As a result, the surface 1*a* of the molten stainless steel 1 in the inner space 101*a* of the tundish 101 is lowered. The supply of the $N_2$ gas 4*b* into the inner space 101*a* is continued also during the replacement of the ladle 2. The interior of the tundish 101 at this time is in a state such as illustrated by process C in FIG. 3.

During the replacement of the ladle 2, the opening area of the inlet port 101*e* of the immersion nozzle 101*d* is adjusted with the stopper 104 and the outflow rate of the molten stainless steel 1, that is, the casting rate, is controlled such that the surface 1*a* of the molten stainless steel 1 in the inner space 101*a* does not fall below the spout 3*a* of the long nozzle 3. By continuously casting the molten stainless steel 1 of the plurality of ladles 2 in the above-described manner, it is possible to eliminate a seam in the slab 1*b* which occurs when the ladle 2 is replaced. Further, the change in quality of the slab 1*b* in the initial period of casting which occurs each time the ladle 2 is replaced can be reduced. Further, it is possible to omit a step for retaining the molten stainless steel 1 in the tundish 101 until the casting is started, such a step being necessary when the casting is ended for each single ladle 2.

Further, when the casting advances, so no molten stainless steel 1 remains in the replacement ladle 2, and the casting is ended, the ladle 2 and the long nozzle 3 are removed. The interior of the tundish 101 at this time is in a state such as illustrated by process D in FIG. 3. At this time, there is no new downward flow of the molten stainless steel 1, and the surface 1*a* and the TD powder 5 are not disturbed by the falling steel. Therefore, the dissolution of the $N_2$ gas 4*b* in the molten stainless steel 1 is prevented until the casting is ended.

Even before the spout 3*a* of the long nozzle 3 is immersed into the molten stainless steel 1 in the inner space 101*a* (see process A in FIG. 3), the admixture of the air and Ar gas 4*a* caused by dragging into the molten stainless steel 1 is reduced because the distance between the spout 3*a* and the bottom of the main body 101*b* of the tundish 101 is small, the distance between the spout 3*a* and the surface 1*a* of the molten stainless steel 1 is small, and the surface 1*a* is hit by the molten stainless steel 1 only for a limited short period of time until the spout 3*a* is immersed.

Where the $N_2$ gas 4*b* is used instead of the Ar gas as the seal gas when the surface 1*a* is hit by the molten stainless steel 1, or where the TD powder 5 is sprayed on the surface 1*a* and the $N_2$ gas 4*b* is used as the seal gas, excessive amount of the $N_2$ gas 4*b* can be dissolved in the molten stainless steel 1 and this component can make the steel unsuitable as a product. In addition, a large amount of inclusions caused by TiN can be formed. Therefore, it may be necessary to dispose of the entire stainless steel billet 1*c* which has been cast from the molten stainless steel 1 remaining in the inner space 101*a* in the initial period of casting until the spout 3*a* of the long nozzle 3 is immersed. However, by using the Ar gas 4*a* in the initial period of casting, it is possible to fit the components of the molten stainless steel 1 into the prescribed ranges, without causing significant changes thereof, and to prevent the formation of TiN. Further, $Al_2O_3$ generated in the secondary refining process is converted into $12CaO.7Al_2O_3$ by at least one of the FeSiCa alloy and metallic calcium and dissolved in the molten stainless steel 1. Since the stainless steel billet 1*c* cast from the molten stainless steel 1 including very small amounts of air or Ar gas 4*a* admixed thereto in the initial period of casting does not include large inclusions and has the required composition, it can be used as a product after surface grinding is performed to remove bubbles generated by the admixed Ar gas 4*a*.

Further, the stainless steel billet 1*c* which has been cast over a period of time other than the abovementioned initial period of casting, this period of time taking a major part of the casting interval of time from after the initial period of casting to the end of casting, is not affected by the air or Ar gas 4*a* that has been admixed in the initial period of casting, and it can be also said that the admixture of the $N_2$ gas 4*b* is prevented by the TD powder 5. Therefore, in the stainless steel billet 1*c* cast over a period of time other than the initial period of casting, the content of nitrogen is not increased over that after the secondary refining and the occurrence of surface defects caused by bubbles of the admixed air is also prevented.

Furthermore, since the molten stainless steel 1 is shielded by the TD powder 5 from the $N_2$ gas 4*b*, the generation of TiN in the molten stainless steel 1 is greatly suppressed. Furthermore, the $Al_2O_3$ generated in the secondary refining process is converted into $12CaO.7Al_2O_3$ by at least one of the FeSiCa alloy and metallic calcium and dissolved in the molten stainless steel 1.

Therefore, in the stainless steel billet 1*c* cast over a period of time other than the initial period of casting, the appearance of surface defects caused by large inclusions and bubbles is greatly suppressed and the billet can be directly used as a product.

Embodiment 2

In the continuous casting method according to Embodiment 2 of the invention, the FeSiCa alloy or metallic calcium is not added to the molten stainless steel 1 in the secondary refining process in the continuous casting method according to Embodiment 1. Instead, a dolomite graphite layer covering the inner wall surface of the immersion nozzle to the tundish 101 is formed thereon.

Further, in Embodiment 2, the reference numerals used are the same as those in the abovementioned drawings to denote the same or similar constituent elements, and detailed explanation thereof is therefore omitted.

Figure 4:
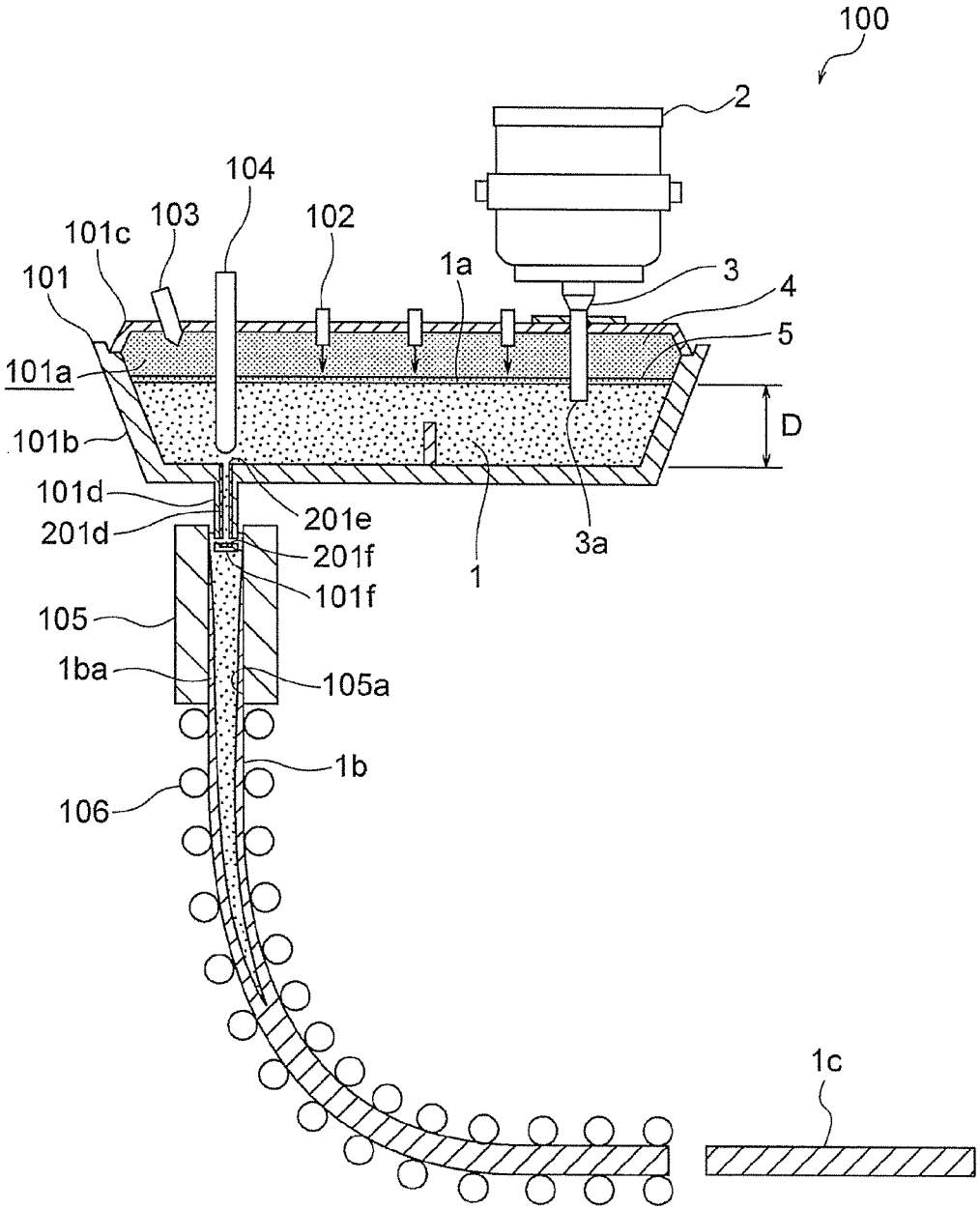
FIG. 4 is a schematic diagram illustrating the configuration of a continuous casting apparatus which is used in the continuous casting method according to Embodiment 2 of the present invention.

Referring to FIG. 4, in the same manner as in Embodiment 1, the immersion nozzle 101*d* extends from the bottom of the main body 101*b* of the tundish 101 of the continuous casting apparatus 100 into the through hole 105*a* of the casting mold 105. Further, the entire inner wall surface of the immersion nozzle 101*d* and the entire inner wall surface of the tip 101*f* are covered with respective inner layers 201*d* and 201*f* constituted by dolomite graphite. An inlet port 201*e* for fitting the stopper 104 is formed in the inner layer 201*d*.

Dolomite graphite includes MgO (magnesium oxide), CaO (calcium oxide) and C (carbon) as components. For example, dolomite graphite has a composition including MgO: 24.0 mass %, CaO: 39.0 mass %, and C: 35.0 mass %. Dolomite graphite reacts as represented by the following equation (1) and implements the conversion of $Al_2O_3$ into $12CaO.7Al_2O_3$ having a low melting point.

$$7Al_2O_3+12CaO \rightarrow 12CaO.7Al_2O_3 \quad (1)$$

Therefore, dolomite graphite acts similarly to a FeSiCa alloy and metallic calcium added to the molten stainless steel 1 in Embodiment 1.

Dolomite graphite of the inner layers 201*d* and 201*f* constitutes a Ca-containing material.

Therefore, $Al_2O_3$ contained in the molten stainless steel 1 flowing into the immersion nozzle 101*d* during casting is converted into $12CaO.7Al_2O_3$ and melts and disperses in the molten stainless steel 1. As a result, the adhesion and deposition of $Al_2O_3$ on the immersion nozzle 101*d* and periphery thereof is suppressed and the formation of surface defects caused by precipitation of $Al_2O_3$ as large inclusions in the stainless steel billet 1*c* after the casting is greatly reduced.

Further, since dolomite graphite is not added to the molten stainless steel 1 in the tundish 101, the layer of the TD powder 5 covering the molten stainless steel 1 is not disturbed. As a result, the $N_2$ gas 4*b* is prevented from dissolving in the molten stainless steel 1 through the disturbed TD powder 5 and the formation of surface defects caused by precipitation of TiN as large inclusions is greatly reduced.

Other features and operations relating to the continuous casting method according to Embodiment 2 of the invention are the same as those of Embodiment 1 and the explanation thereof is herein omitted.

The effect obtained with the continuous casting method according to Embodiment 2 is the same as that obtained with the continuous casting method of Embodiment 1.

The inner layers 201*d* and 201*f* constituted by dolomite graphite in Embodiment 2 may also be used in the immersion nozzle 101*d* in Embodiment 1. As a result, $Al_2O_3$ contained in the molten stainless steel 1 can be more reliably converted into $12CaO.7Al_2O_3$.

EXAMPLES

Examples of casting stainless steel billets by using the continuous casting methods according to Embodiments 1 and 2 will be explained hereinbelow.

Examples 1 to 5 and Comparative Example 1 in which slabs, which are stainless steel billets, are cast using the continuous casting methods according to Embodiments 1 and 2 are compared with respect to a Ti-added ferritic stainless steel.

Examples 1 to 3 correspond to the continuous casting method of Embodiment 1. In these examples, a FeSiCa alloy is added in the secondary refining process.

Example 4 corresponds to the continuous casting method of Embodiment 1. In this example, metallic calcium is added in the secondary refining process.

Example 5 corresponds to the continuous casting method of Embodiment 2. In this example, a layer constituted by dolomite graphite is provided on the inner wall surface of the immersion nozzle in the tundish. The specifications of the chemical composition of the stainless steel in Example 5 are the same as those of the stainless steel in Example 4.

In Comparative Example 1, a CaSi wire is charged as a Ca-containing material into molten stainless steel covered with a TD powder inside the tundish, without adding the FeSiCa alloy or metallic calcium in the secondary refining process, in the continuous casting method of Embodiment 1.

The detection results presented hereinbelow are obtained by sampling from the slabs cast in the stationary state, except for the initial period of casting, in the examples and by sampling from the slabs cast over the same time as in the examples from the beginning of casting in the comparative example.

The specifications of the chemical compositions of the stainless steel in examples and comparative examples are presented in Table 1, and the casting conditions representing the type of the seal gas, the type of the immersion nozzle, whether the TD powder is used, and the Ca-containing material to be added to the stainless steel are presented in Table 2.

TABLE 1

Specifications of chemical compositions of stainless steels in examples and comparative examples

| | Chemical components (mass %) | | | | | | |
|---|---|---|---|---|---|---|---|
| | C | Cr | Si | Mn | Ti | Al | N |
| Example 1 | ≤0.014 | 11.00 | 0.60 | ≤0.70 | 0.25 | ≤0.05 | ≤0.030 |
| Example 2 | ≤0.030 | 11.00 | 0.60 | ≤0.70 | 0.30 | ≤0.15 | ≤0.030 |

TABLE 1-continued

Specifications of chemical compositions of stainless steels in examples and comparative examples

| | Chemical components (mass %) | | | | | | |
|---|---|---|---|---|---|---|---|
| | C | Cr | Si | Mn | Ti | Al | N |
| Example 2 | ≤0.020 | 11.00 | 0.30 | ≤0.70 | 0.20 | ≤0.10 | ≤0.030 |
| Examples 4, 5 | ≤0.014 | 11.50 | ≤0.20 | ≤0.70 | 0.30 | ≤0.07 | ≤0.030 |
| Comparative Example 1 | ≤0.030 | 10.00 | 0.90 | 0.25 | 0.15 | ≤0.07 | ≤0.015 |

TABLE 2

Casting conditions in examples and comparative example

| | Seal gas type | Pouring nozzle type | TD powder | Ca-containing material |
|---|---|---|---|---|
| Example 1 | $N_2$ | Long nozzle | Used | FeSiCa alloy |
| Example 2 | $N_2$ | Long nozzle | Used | FeSiCa alloy |
| Example 3 | $N_2$ | Long nozzle | Used | FeSiCa alloy |
| Example 4 | $N_2$ | Long nozzle | Used | Metallic calcium |
| Example 5 | $N_2$ | Long nozzle | Used | Dolomite graphite |
| Comparative Example 1 | $N_2$ | Long nozzle | Used | CaSi wire |

Figure 6:
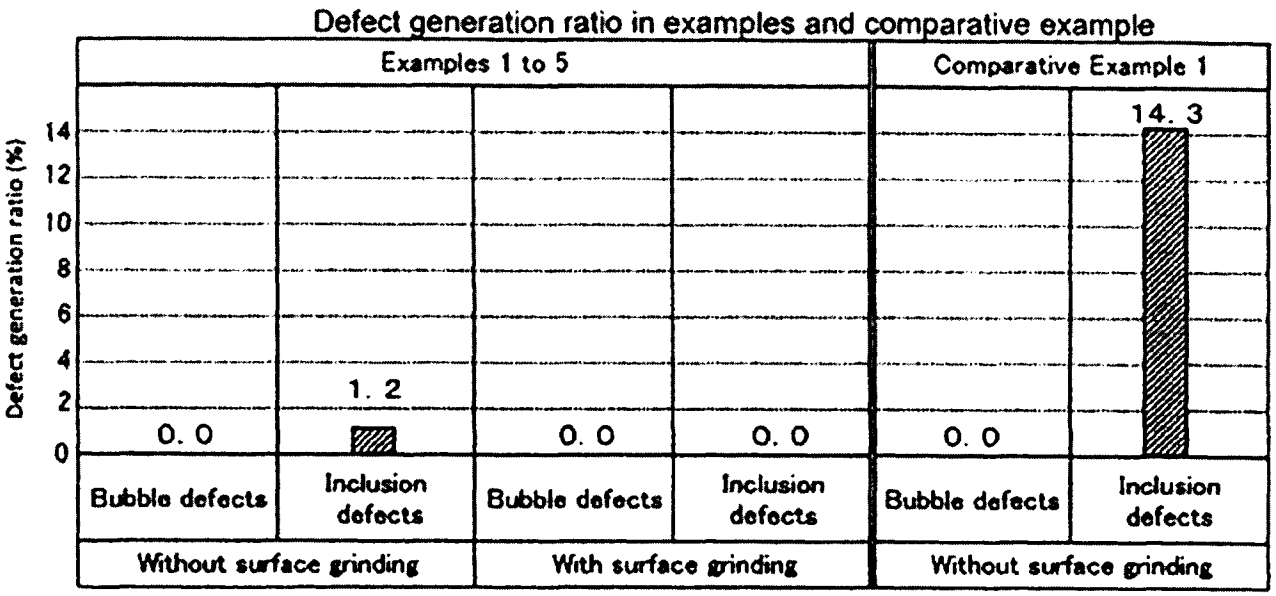
FIG. 6 is a table showing the ratio of the number of slabs in which bubble defects were detected for Comparative Examples 1 to 5.

Further, in FIG. 6, the ratio of the number of slabs in which bubble defects were detected, from a large number of produced slabs, and the number of slabs in which defects caused by inclusions were detected, from the same number of slabs, was compared between the combined results of Examples 1 to 5 and the results of Comparative Example 1. FIG. 6 presents the results obtained with and without surface grinding in Examples 1 to 5 and the results obtained without surface grinding in Comparative Example 1. The slab surface was ground to a thickness of 2 mm on one side (4 mm on both sides).

FIG. 6 indicates that in Examples 1 to 5, the generation ratio of bubble defects is 0 even when slabs are not ground, and the generation ratio of the defects caused by inclusions is also suppressed. Further, where the slab surface is ground in Examples 1 to 5, the defect generation ratio is 0 and excellent quality is obtained.

Figure 5:
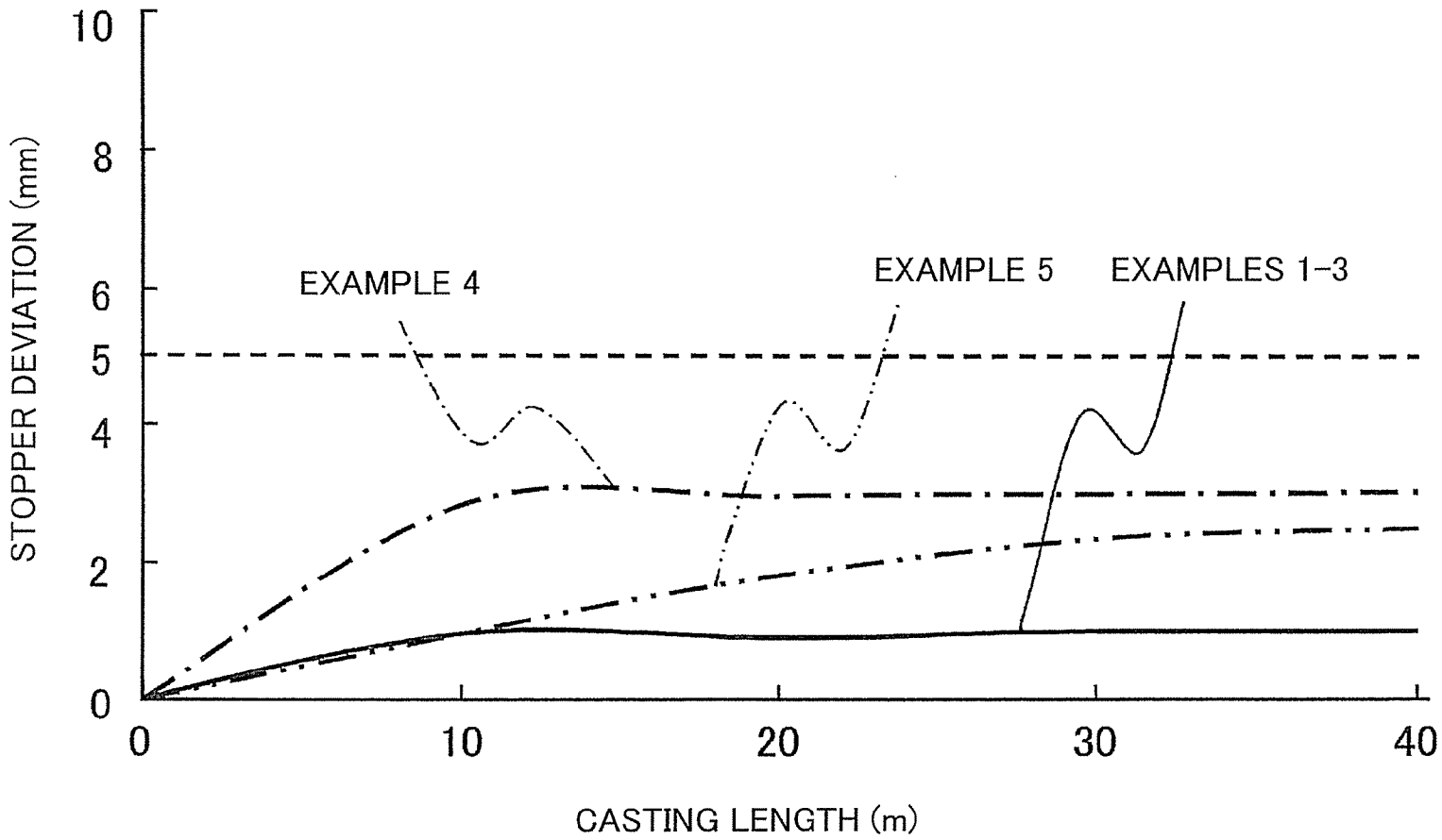
FIG. 5 illustrates the comparison of deposition states of precipitates in the immersion nozzle of the tundish during continuous casting of Examples 1 to 5.

In FIG. 5, the deposition state of precipitates in the immersion nozzle of the tundish during slab casting is compared for Examples 1 to 5. In FIG. 5, the length of the continuously cast stainless steel is plotted against the abscissa and the deviation of the stopper (see the stopper 104 in FIG. 2) is plotted against the ordinate. The stopper deviation, as referred to herein, is the vertical displacement of the stopper when the inlet (see the inlet port 101*e* in FIG. 1 and the inlet port 201*e* in FIG. 4) of the immersion nozzle of the tundish are closed. In other words, where there is no adhesion of the precipitates to the inlet of the immersion nozzle, the stopper deviation is 0. Meanwhile, where the precipitates are deposited on the inlet of the immersion nozzle, the stopper position shifts upward at the time of closure, and this displacement becomes the stopper deviation. Where the stopper deviation reaches 5 mm, it is assumed that the inlet of the immersion nozzle is clogged by the precipitates.

In FIG. 5, in each of Examples 1 to 3, the stopper deviation is about 1 mm and demonstrates a similar change even when the casting length is extended, and the inlet of the immersion nozzle is not clogged. In Example 4, the stopper deviation is about 3 mm and demonstrates a similar change even when the casting length is extended, and the inlet of the immersion nozzle is not clogged. In Example 5, the stopper deviation reaches only about 2.5 mm even when the casting length is extended, and the inlet of the immersion nozzle is not clogged.

The present invention was also applied to steel grades which included Ti as a component, such as 18Cr-1Mo-0.5Ti and 22Cr-1.2Mo—Nb—Ti stainless steels, in addition to the above-described steel grades, and the surface defect suppression effect and immersion nozzle clogging prevention effect, such as demonstrated in Examples 1 to 5, were confirmed.

The continuous casting methods according to Embodiments 1 and 2 are explained with reference to stainless steels including Ti as a component, but the methods can be also effectively applied to stainless steels which require aluminum deoxidation in the secondary refining process and include Nb as a component.

Further, the continuous casting methods according to Embodiments 1 and 2 are applied to the production of stainless steel, but it may be also applied to the production of other metals.

The control in the tundish 101 in the continuous casting methods according to Embodiments 1 and 2 is applied to continuous casting, but it may be also applied to other casting methods.

The invention claimed is:

1. A continuous casting method for casting a solid metal by pouring a molten metal, subjected to aluminum deoxidation in a ladle, into a tundish and continuously pouring the molten metal in the tundish into a casting mold, the continuous casting method comprising:

a long nozzle installation step for providing in the ladle a long nozzle extending into the tundish as a pouring nozzle for pouring the molten metal in the ladle into the tundish;

a casting step for pouring the molten metal into the tundish through the long nozzle, while a spout of the long nozzle is being immersed into the molten metal, which has been poured into the tundish, and pouring the molten metal in the tundish into the casting mold;

a spraying step for spraying a tundish powder so that the powder covers a surface of the molten metal in the tundish;

a seal gas supply step for supplying a nitrogen gas as a seal gas around the molten metal upon which the tundish powder has been sprayed; and an addition step for adding a calcium-containing material to the molten metal in a state other than a state wherein the molten metal is retained in the tundish.

2. The continuous casting method of claim 1, wherein the molten metal includes titanium as a component.

3. The continuous casting method of claim 1, wherein the calcium-containing material is added in a refining process which is a process preceding the casting of the molten metal.

4. The continuous casting method of claim 3, wherein the refining process is performed in a vacuum vessel of a vacuum oxygen decarburization apparatus, and the casting step for pouring molten metal into the tundish is performed in a casting apparatus.

5. The continuous casting method of claim 1, wherein the calcium-containing material is included in an inner wall surface of a nozzle for pouring the molten metal from the tundish into the casting mold.

6. The continuous casting method of claim 1, wherein before the tundish powder is sprayed, argon gas is supplied as a seal gas around the molten metal in the tundish.

7. The continuous casting method of claim 1, wherein the addition step for adding the calcium-containing material to the molten metal is performed in a vacuum vessel of a vacuum oxygen decarburization apparatus, and the casting step for pouring molten metal into the tundish is performed in a casting apparatus.

8. The continuous casting method of claim 7, wherein the addition step for adding the calcium-containing material to the molten metal includes the ladle retaining the molten metal, whereby the ladle is positioned in the vacuum vessel of the vacuum oxygen decarburization apparatus.

9. The continuous casting method of claim 8 further comprising a transferring step for removing the ladle from the vacuum vessel of the vacuum oxygen decarburization apparatus after adding calcium-containing material to the molten metal and transferring the ladle to the tundish of the casting apparatus before pouring the molten metal into the tundish.

* * * * *